US010937584B2

(12) United States Patent
Kawashima et al.

(10) Patent No.: US 10,937,584 B2
(45) Date of Patent: Mar. 2, 2021

(54) COMMON MODE NOISE FILTER

(71) Applicant: Panasonic Intellectual Property Management Co., Ltd., Osaka (JP)

(72) Inventors: Takuji Kawashima, Fukui (JP); Yoshiharu Oomori, Osaka (JP); Yoichi Nagaso, Fukui (JP); Atsushi Shinkai, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 110 days.

(21) Appl. No.: 15/771,385

(22) PCT Filed: Sep. 26, 2017

(86) PCT No.: PCT/JP2017/034612
§ 371 (c)(1),
(2) Date: Apr. 26, 2018

(87) PCT Pub. No.: WO2018/066405
PCT Pub. Date: Apr. 12, 2018

(65) Prior Publication Data

US 2018/0336987 A1 Nov. 22, 2018

(30) Foreign Application Priority Data

Oct. 5, 2016 (JP) ..... JP2016-196910

(51) Int. Cl.
*H01F 17/00* (2006.01)

(52) U.S. Cl.
CPC ... *H01F 17/0013* (2013.01); *H01F 2017/002* (2013.01); *H01F 2017/0066* (2013.01);
(Continued)

(58) Field of Classification Search
CPC ..... H01F 17/0013; H01F 2017/002
See application file for complete search history.

(56) References Cited

U.S. PATENT DOCUMENTS 6,480,087 B1 * 11/2002 Oiwa ..... H01F 5/003 336/200
2003/0052766 A1 3/2003 Tomohiro et al.
(Continued)

FOREIGN PATENT DOCUMENTS

JP 2003-077727 3/2003
JP 2016-157917 A 9/2016

OTHER PUBLICATIONS

International Search Report of PCT application No. PCT/JP2017/034612 dated Jan. 9, 2018.
(Continued)

*Primary Examiner* — Elvin G Enad
*Assistant Examiner* — Malcolm Barnes
(74) *Attorney, Agent, or Firm* — McDermott Will & Emery LLP

(57) ABSTRACT

A common mode noise filter includes a non-magnetic body and first to third coil conductors provided inside the non-magnetic body. The second coil conductor is provided in a downward direction from the first coil conductor. The third coil conductor is provided in the downward direction from the second coil conductor. The first and third coil conductors deviate in a direction perpendicular to the downward direction with respect to the second coil conductor. At least one of the first and third coil conductors overlaps the second coil conductor viewing from the direction perpendicular to the downward direction. This common mode noise filter allows these coil conductors to be magnetically coupled to each other with a preferable balance, thereby preventing degradation of differential signals.

10 Claims, 12 Drawing Sheets

(52) U.S. Cl.
CPC ..... *H01F 2017/0073* (2013.01); *H01F 2017/0093* (2013.01)

(56) References Cited

U.S. PATENT DOCUMENTS

| | | | | |
|---|---|---|---|---|
| 2009/0273429 | A1* | 11/2009 | Nakamura | H01F 17/0006 336/200 |
| 2013/0154783 | A1* | 6/2013 | Kato | H01F 19/04 336/200 |
| 2013/0321115 | A1* | 12/2013 | Lee | H01F 41/046 336/200 |
| 2014/0232501 | A1* | 8/2014 | Kato | H01F 17/0013 336/182 |
| 2014/0368307 | A1* | 12/2014 | Kato | H01F 17/0013 336/200 |
| 2016/0372254 | A1 | 12/2016 | Harada et al. | |
| 2017/0365402 | A1* | 12/2017 | Fukushima | H01F 5/00 |
| 2018/0190423 | A1* | 7/2018 | Ueki | H01F 17/0013 |
| 2019/0014665 | A1* | 1/2019 | Yazaki | H05K 1/181 |
| 2019/0156988 | A1* | 5/2019 | Nakamura | H01F 17/0013 |

OTHER PUBLICATIONS

English Translation of Chinese Search Report dated Sep. 30, 2020 for the related Chinese Patent Application No. 201780004371.9.

* cited by examiner

COMMON MODE NOISE FILTER

This application is a U.S. national stage application of the PCT international application No. PCT/JP2017/034612 filed on Sep. 26, 2017, which claims the benefit of foreign priority of Japanese patent application No. 2016-196910 filed on Oct. 5, 2016, the contents all of which are incorporated herein by reference.

TECHNICAL FIELD

The present invention relates to a common mode noise filter for use in various electronic equipment, such as digital devices, audiovisual (AV) devices, and information communication terminals.

BACKGROUND ART

As a digital data transmission standard for connecting a main IC to a display or a camera in a mobile computing device, a mipi (Mobile Industry Processor Interface) D-PHY standard has been adopted. In this standard, a system that transmits differential signals by using two transmission lines is used. In recent years, the resolution of cameras has been dramatically increased, and accordingly a higher-speed transmission system, that is, a system in which different voltages are transmitted to respective transmission lines from a transmitter by using three transmission lines, and the differences between the lines are obtained by a receiver to perform differential output has been put in practical use as a mipi C-PHY standard.

FIG. 10 is an exploded perspective view of conventional common mode noise filter 501. Common mode noise filter 501 includes a plurality of insulation layers 1*a* and three independent coils 2 to 4. Coil 2 includes coil conductors 2*a* and 2*b* that are connected to each other. Coil 3 includes coil conductors 3*a* and 3*b* that are connected to each other. Coil 4 includes coil conductors 4*a* and 4*b* that are connected to each other. Coils 2 to 4 are laminated in this order from the bottom. When a common mode noise is input to common mode noise filter 501, coils 2 to 4 mutually intensify produced magnetic fluxes and operate as an inductance to reduce the noise.

A conventional common mode noise filter similar to conventional common mode noise filter 501 is disclosed in, for example, PTL 1.

CITATION LIST

Patent Literature

PTL 1: Japanese Patent Laid-Open Publication No. 2003-77727

SUMMARY

A common mode noise filter includes a non-magnetic body and first to third coil conductors provided inside the non-magnetic body. The second coil conductor is provided in a downward direction from the first coil conductor. The third coil conductor is provided in the downward direction from the second coil conductor. The first and third coil conductors are arranged deviate in a direction perpendicular to the downward direction with respect to the second coil conductor. At least one of the first and third coil conductor overlaps the second coil conductor viewing in the direction perpendicular to the downward direction.

In another common mode noise filter, the first, second, and third coil conductors do not overlap each other viewing in the direction perpendicular to the downward direction. An upper surface of the second coil conductor is flush with a lower surface of the first coil conductor. A lower surface of the second coil conductor is flush with an upper surface of the third coil conductor.

These common mode noise filters allow these coil conductors to be magnetically coupled to each other with a good balance, thereby preventing degradation of differential signals.

DETAILED DESCRIPTION OF PREFERRED EMBODIMENTS

Exemplary Embodiment 1

Figure 1:
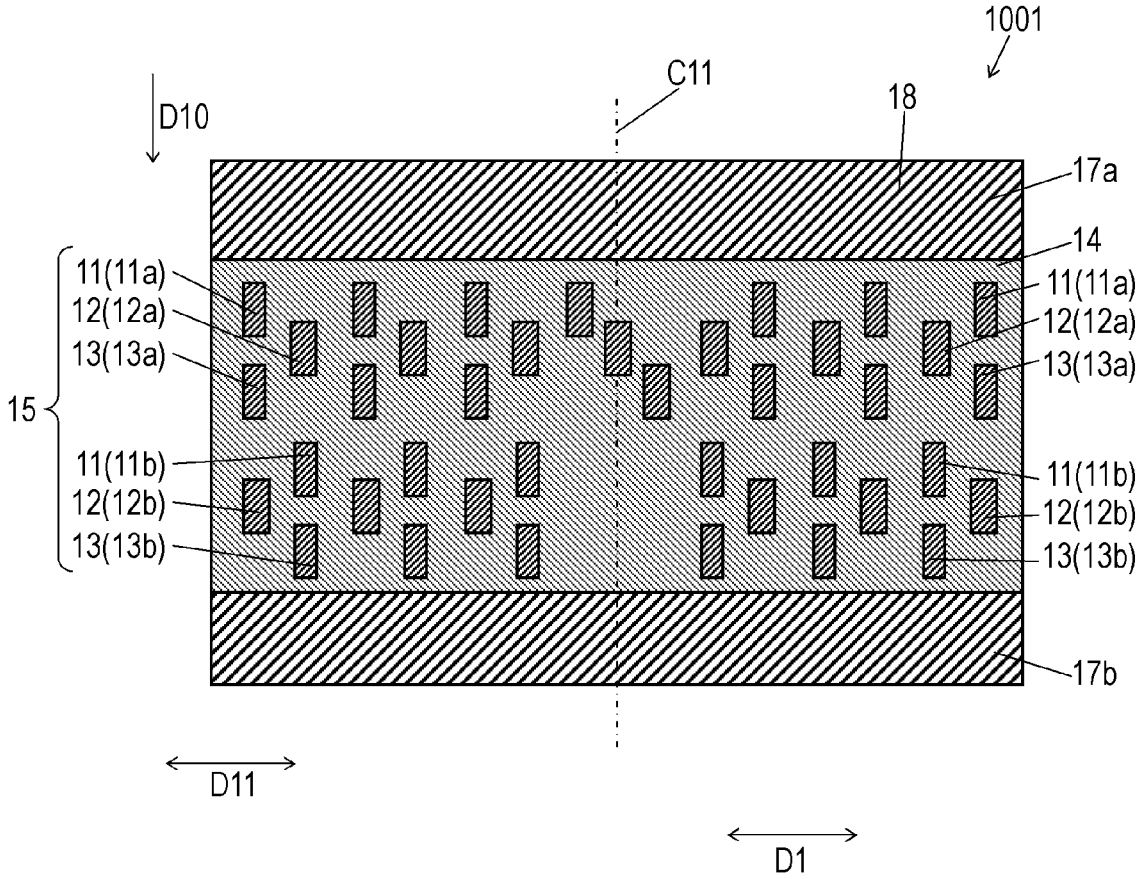
FIG. 1 is a cross-sectional view of a common mode noise filter according to Embodiment 1.
Figure 2A:
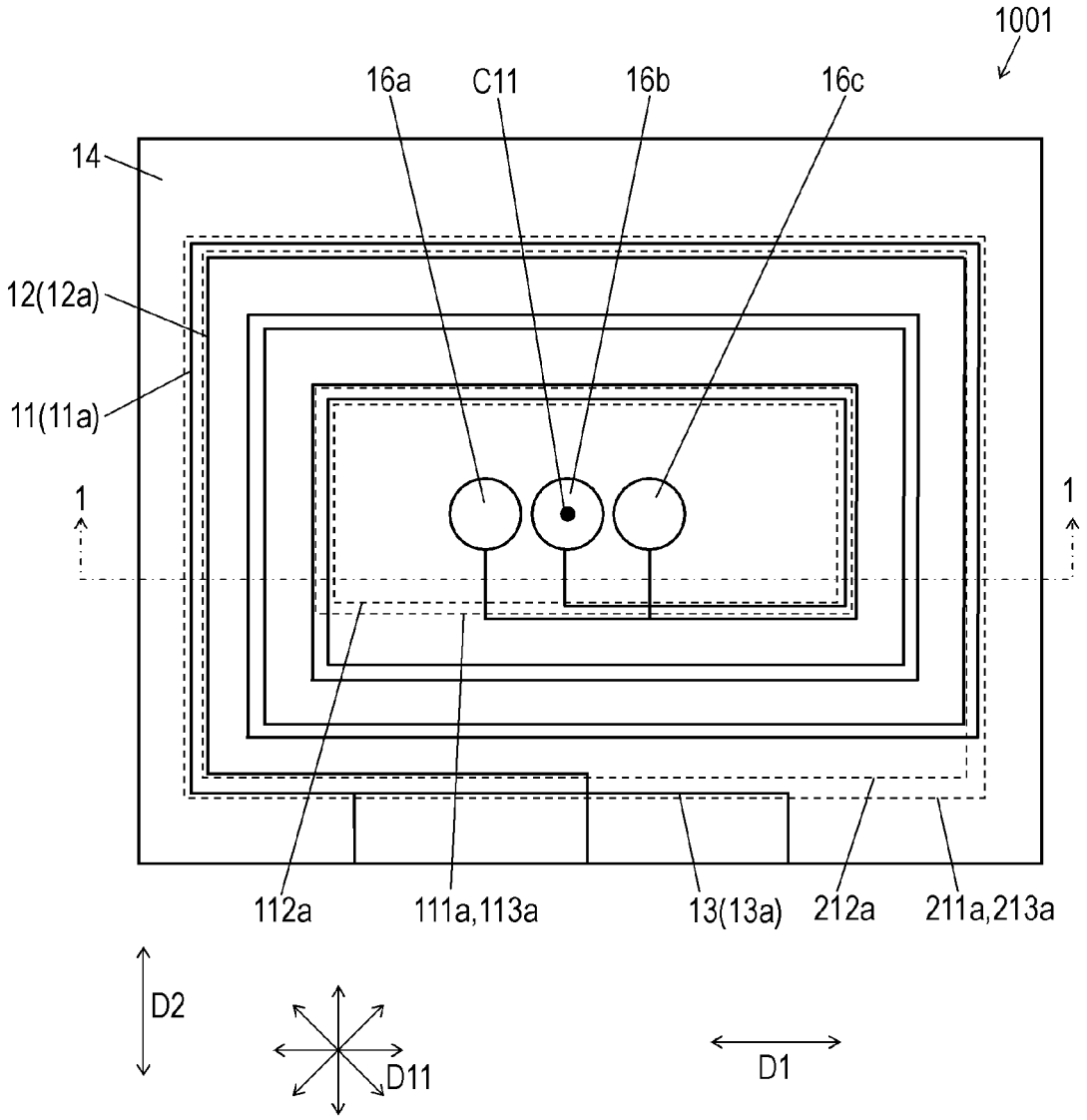
FIG. 2A is a top view of the common mode noise filter according to Embodiment 1.
Figure 2B:
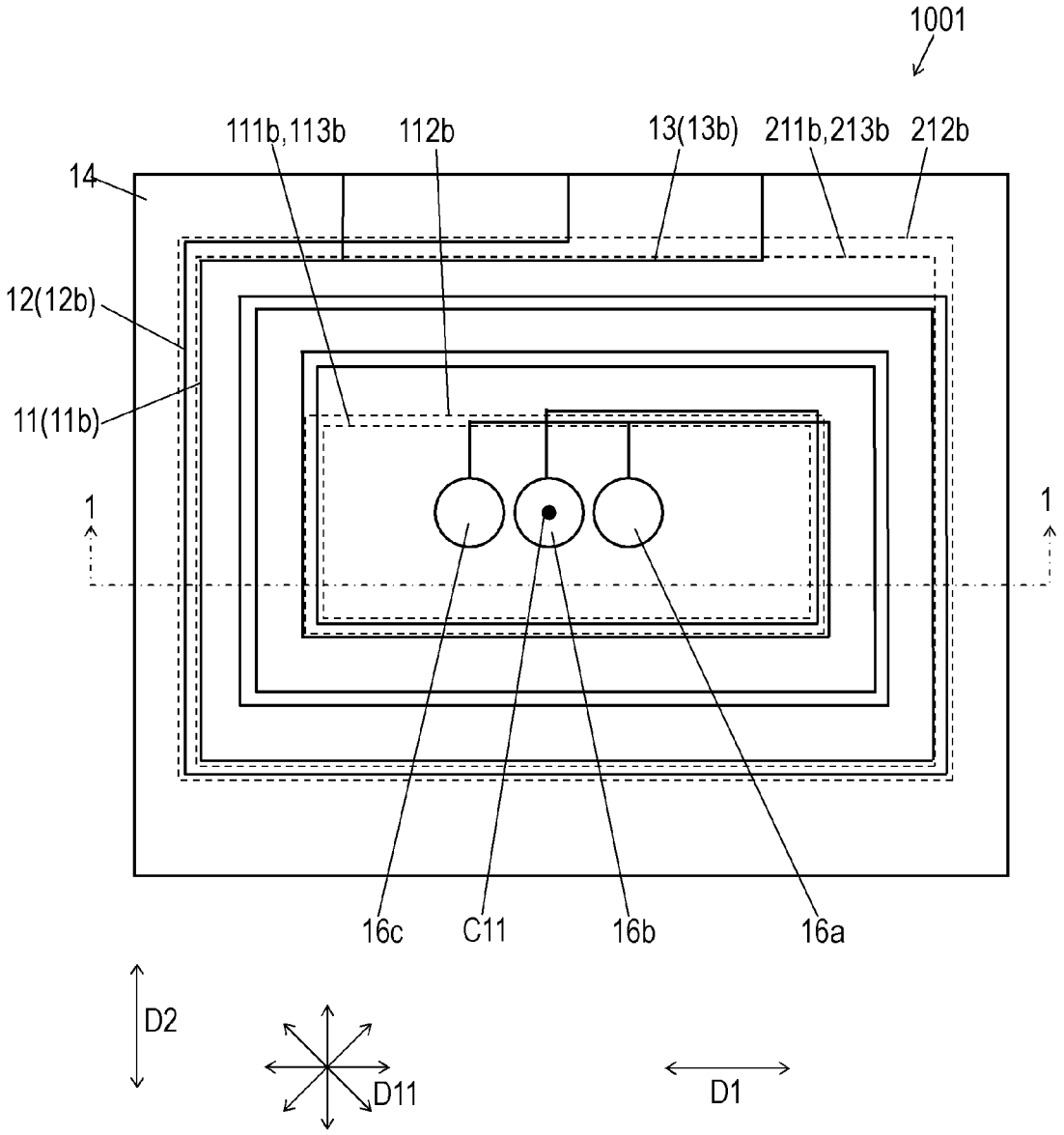
FIG. 2B is a bottom view of the common mode noise filter according to Embodiment 1.
Figure 2C:
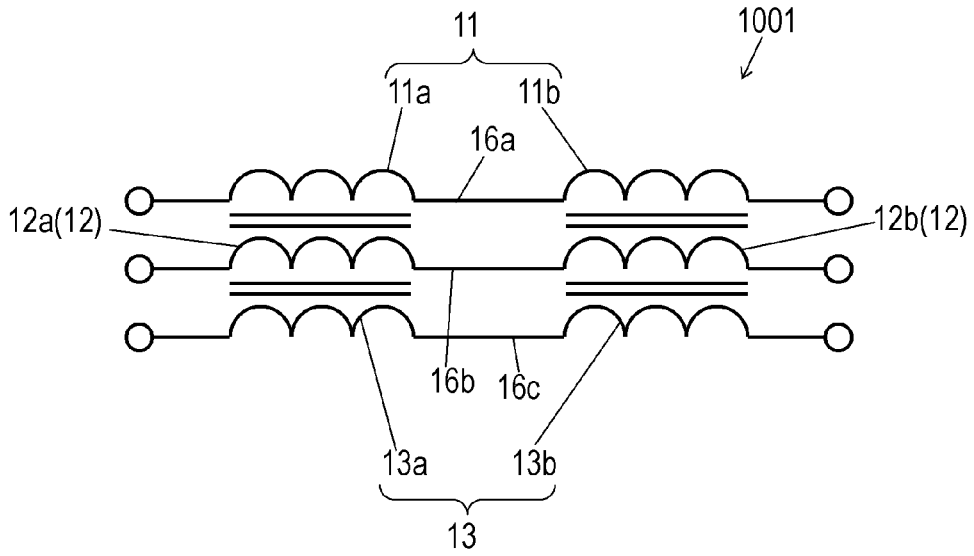
FIG. 2C is a circuit diagram of the common mode noise filter according to Embodiment 1.

FIG. 1 is a cross-sectional view of common mode noise filter 1001 according to Exemplary Embodiment 1. FIG. 2A and FIG. 2B are a top view and a bottom view of common mode noise filter 1001, respectively. FIG. 1 shows a cross section of common mode noise filter 1001 along line 1-1 shown in FIG. 2A and FIG. 2B. FIG. 2C is a circuit diagram of common mode noise filter 1001.

Common mode noise filter 1001 includes non-magnetic body 14 and coil conductors 11*a*, 11*b*, 12*a*, 12*b*, 13*a*, and 13*b* provided inside non-magnetic body 14. Coil conductors 11*a* and 11*b* are electrically connected to each other to constitute coil 11. Coil conductors 12*a* and 12*b* are electrically connected to each other to constitute coil 12. Coil conductors 13*a* and 13*b* are electrically connected to each other to constitute coil 13. In accordance with Embodiment 1, coil conductors 11*a* and 11*b* are electrically connected in series to each other through via-conductor 16*a* to constitute coil 11. Coil conductors 12*a* and 12*b* are electrically connected in series to each other through via-conductor 16*b* to constitute coil 12. Coil conductors 13*a* and 13*b* are electrically connected in series to each other through via-conductor 16*c* to constitute coil 13. Coils 11, 12, and 13 are independent from each other.

Non-magnetic body 14 includes plural non-magnetic layers staked on one another. Coil conductors 11*a* to 13*a* and 11*b* to 13*b* are provided by spirally plating or printing the respective non-magnetic layers with conductive material, such as silver.

As illustrated in FIG. 2A, coil conductor 11*a* has a spiral shape with one or more turns from inner circumference 111*a* to outer circumference 211*a*. Coil conductor 12*a* has a spiral shape with one or more turns from inner circumference 112*a* to outer circumference 212*a*. Coil conductor 13*a* has a spiral shape with one or more turns from inner circumference 113*a* to outer circumference 213*a*. As illustrated in FIG. 2B, coil conductor 11*b* has a spiral shape with one or more turns from inner circumference 111*b* to outer circumference 211*b*. Coil conductor 12*b* has a spiral shape with one or more turns from inner circumference 112*b* to outer circumference 212*b*. Coil conductor 13*b* a spiral shape with one or more turns from inner circumference 113*b* to outer circumference 213*b*. In other words, each of coil conductors 11*a* to 13*a* and 11*b* to 13*b* has the spiral shape with M turns, where M is a number equal to or greater than one. Each of inner circumferences 111*a* to 113*a* and 111*b* to 113*b* and outer circumferences 211*a* to 213*a* and 211*b* to 213*b* has a rectangular shape with long sides extending in longitudinal direction D1 and short sides extending in lateral direction D2 perpendicular to longitudinal direction D1 and being shorter than the long sides. The conductors are the same in the width, pitch, and thickness of a spiral-shaped portion, that is, a main part excluding a portion used for, for example, wiring. Longitudinal direction D1 and lateral direction D2 are perpendicular to downward direction D10.

Coil conductor 11*a* constituting coil 11, coil conductor 12*a* constituting coil 12, coil conductor 13*a* constituting coil 13, coil conductor 11*b* constituting coil 11, coil conductor 12*b* constituting coil 12, and coil conductor 13*b* constituting coil 13 are disposed in this order from above to constitute laminated body 15. In other words, coil conductor 12*a* is provided in downward direction D10 from coil conductor 11*a*. Coil conductor 13*a* is provided in downward direction D10 from coil conductor 12*a*. Coil conductor 11*b* is provided in downward direction D10 from coil conductor 13*a*. Coil conductor 12*b* is provided in downward direction D10 from coil conductor 11*b*. Coil conductor 13*b* is provided in downward direction D10 from coil conductor 12*b*.

In downward direction D10, between two coil conductors constituting one of the three coils, one of two coil conductors constituting one of the other two coils and one of two coil conductors constituting another of the other two coils are located. In other words, in downward direction D10, coil conductor 12*a* constituting coil 12 and coil conductor 13*a* constituting coil 13 are located between coil conductors 11*a* and 11*b* constituting coil 11. In downward direction D10, coil conductor 11*b* constituting coil 11 and coil conductor 13*b* constituting coil 13 are located between coil conductors 12*a* and 12*b* constituting coil 12. In downward direction D10, coil conductor 11*b* constituting coil 11 and coil conductor 12*b* constituting coil 12 are located between coil conductors 13*a* and 13*b* constituting coil 13.

Coil 11 is magnetically coupled to coil 12. Coil 12 is magnetically coupled to coil 13. Coil 11 is magnetically coupled to coil 13.

In common mode noise filter 1001, coil conductors 11*a* and 13*a* and coil conductors 11*b* and 13*b* deviate in direction D11 perpendicular to downward direction D10 with respect to coil conductors 12*a* and 12*b* viewing from above. In other words, coil conductors 11*a* and 13*a* constituting coils 11 and 13 deviate in direction D11 with respect to coil conductor 12*a* constituting coil 12 viewing from above. Coil conductors 11*b* and 13*b* constituting coils 11 and 13 deviate in direction D11 with respect to coil conductor 12*b* constituting coil 12 viewing from above.

Coil conductors 11*a* to 13*a* and 11*b* to 13*b* have spiral shapes wound about coil axis C11. The state in which spirally wound coil conductors 11*a*, 13*a*, 11*b*, and 13*b* deviate in direction D11 with respect to coil conductors 12*a* and 12*b* means that, in any cross-section of laminated body 15 parallel with downward direction D10, portions of coil conductors 11*a*, 13*a*, 11*b*, and 13*b* at a certain number of turn counted from respective inner circumferences 111*a*, 113*a*, 111*b*, and 113*b* toward respective outer circumferences 211*a*, 213*a*, 211*b*, and 213*b* deviate in downward direction D11 with respect to portions of coil conductors 12*a* and 12*b* at the certain number of turn counted from respective inner circumferences 112*a* and 112*b* toward respective outer circumferences 212*a* and 212*b* viewing from above. Specifically, in any cross-section of laminated body 15 parallel with downward direction D10, a portion of coil conductor 12*a* at a certain number of turn counted from inner circumference 112*a* toward outer circumference 212*a* deviates toward coil axis C11 in direction D11 with respect to a cross-section at portions of coil conductors 11*a* and 13*a* at the certain number of turn counted from respective inner circumferences 111*a* and 113*a* toward respective outer circumferences 211*a* and 213*a* viewing from above. In any cross-section of laminated body 15 parallel with downward direction D10, portions of coil conductor 11*b* and 13*b* at a certain number of turn counted from respective inner circumferences 111*b* and 113*b* toward respective outer circumferences 211*b* and 213*b* deviate toward coil axis C11 in direction D11 with respect to a portion of coil conductor 12*b* at the certain number of turn counted from inner circumference 112*b* toward outer circumference 212*b* viewing from above.

Coil conductors 11*a* and 13*a* are disposed substantially at the same position viewing from above to face each other in downward direction D10. Coil conductors 11*b* and 13*b* are disposed substantially at the same position viewing from above to face each other. A portion of coil conductor 11*a* having the spiral shape constituting coil 11 overlaps a portion of coil conductor 13*a* having the spiral shape constituting coil 13 viewing from above. A portion of coil conductor 11*b* having the spiral shape constituting coil 11 overlaps a portion of coil conductor 13*b* having the spiral shape constituting coil 13 viewing from above.

In common mode noise filter 1001 illustrated in FIG. 1, FIG. 2A, and FIG. 2B, coil conductors 11*a* and 13*a* completely overlap each other viewing from above, and coil conductors 11*b* and 13*b* completely overlap each other viewing from above. Coil conductors 11*a* and 13*a* may partially overlap each other viewing from above, and coil conductors 11*b* and 13*b* may partially overlap each other viewing from above.

In common mode noise filter 1001, the same number of coil conductors are located at the same position viewing from above. This configuration allows stresses applied at the time of lamination to be preferably uniform. The locations of coil conductors 11*b* and 13*b* viewing from above may be replaced with the location of coil conductor 12*b* viewing from above.

A part of coil conductor 11*a* constituting coil 11 and a part of coil conductor 13*a* constituting coil 13 overlap coil conductor 12*a* constituting coil 12 viewing from direction D11. Apart of coil conductor 11*b* constituting coil 11 and a part of coil conductor 13*b* constituting coil 13 overlap coil conductor 12*b* constituting coil 12 viewing from direction D11. In other words, coil conductor 11*a* constituting coil 11 and coil conductor 13*a* constituting coil 13 partially overlap coil conductor 12*a* constituting coil 12 viewing from direction D11. In addition, coil conductor 11*b* constituting coil 11 and coil conductor 13*b* constituting coil 13 partially overlap coil conductor 12*b* constituting coil 12 viewing from direction D11.

Non-magnetic body 14 has coil conductors 11*a*, 11*b*, 12*a*, 12*b*, 13*a*, and 13*b* built therein and includes plural non-magnetic layers stacked on one another. These non-magnetic layers are made of non-magnetic material, such as Cu—Zn ferrite or glass ceramics, having sheet shapes.

Coil conductors 11*a*, 11*b*, 12*a*, 12*b*, 13*a*, and 13*b* are formed by, for example, vapor-depositing on, plating, or printing the non-magnetic layers with conductive material, such as metal.

Magnetic bodies 17*a* and 17*b* made of magnetic material, such as Ni—Cu—Zn ferrite, are provided above and below non-magnetic body 14, respectively. Common mode noise filter 1001 does not necessarily include magnetic bodies 17*a* and 17*b*. Each of magnetic bodies 17*a* and 17*b* may include plural non-magnetic layers and plural magnetic layers that are alternately stacked.

Laminated body 18 has the above-described configuration. Six outer electrodes connected to respective ends of coil conductors 11*a*, 11*b*, 12*a*, 12*b*, 13*a*, and 13*b* are provided on both end surfaces of laminated body 18.

As described above, in common mode noise filter 1001 according to Embodiment 1, a part of coil 11 is adjacent to a part of coil 12 viewing from direction D11. Apart of coil 12 is adjacent to a part of coil 13 viewing from direction D11. Coil 11 is adjacent to coil 13 in downward direction D10 (up-and-down direction). Therefore, coils 11, 12, and 13 are magnetically coupled to each other with a preferable balance. In other words, coils 11 and 12 are magnetically coupled to each other, coils 12 and 13 are magnetically coupled to each other at the same level of strength as that of magnetic coupling between coils 11 and 12. Coils 11 and 13 are magnetically coupled to each other at the same level of strength as that of magnetic coupling between coils 11 and 12 and that of magnetic coupling between coils 12 and 13. This configuration prevents degradation of differentials signal input to coils 11 to 13.

A part of coil 11 and a part of coil 13 overlap coil 12 viewing from direction D11. This configuration reduces the height of common mode noise filter 1001.

In common mode noise filter 1001 according to Embodiment 1, each coil includes two coil conductors that are electrically connected to each other. In the common mode noise filter according to Embodiment 1, even in the case where each coil includes three or more coil conductors that are electrically connected to each other, the same effect is achieved. Alternatively, even in the case where each coil includes a single coil conductor, the same effect is achieved.

Figure 3:
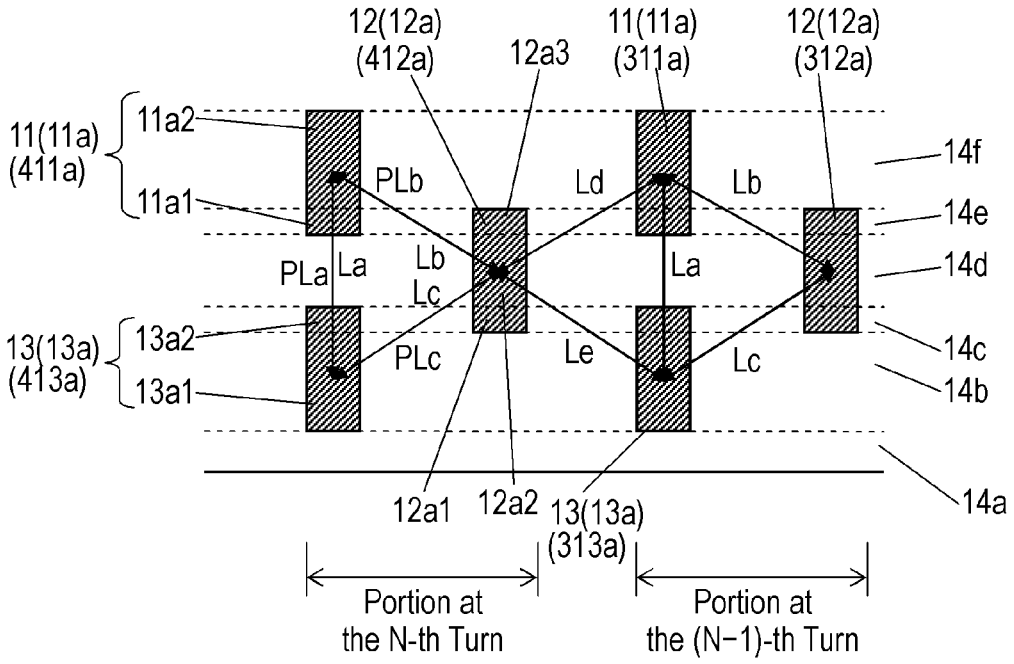
FIG. 3 is an enlarged cross-sectional view of the common mode noise filter according to Embodiment 1.

FIG. 3 is an enlarged cross-sectional view of common mode noise filter 1001 according to Embodiment 1, and illustrates a cross-section of common mode noise filter 1001 parallel with downward direction D10. FIG. 3 illustrates portion 412*a* of coil conductor 12*a* of coil 12 at the N-th turn from inner circumference 112*a* of coil conductor 12*a*, portion 312*a* of coil conductor 12*a* of coil 12 at the (N−1)-th turn from inner circumference 112*a* of coil conductor 12*a*, portion 411*a* of coil conductor 11*a* of coil 11 at the N-th turn from inner circumference 111*a* of coil conductor 11*a*, portion 311*a* of coil conductor 11*a* of coil 11 at the (N−1)-th turn from inner circumference 111*a* of coil conductor 11*a*, portion 413*a* of coil conductor 13*a* of coil 13 the N-th turn from inner circumference 113*a* of coil conductor 13*a*, and portion 313*a* of coil conductor 13*a* of coil 13 at the (N−1)-th turn from inner circumference 113*a* of coil conductor 13*a* of coil 11 at a cross-section of common mode noise filter 1001 parallel with downward direction D10 (N is a number satisfying $1 \leq N \leq M$).

Distance La between portion 411*a* of coil conductor 11*a* and portion 413*a* of coil conductor 13*a*, distance Lb between portion 411*a* of coil conductor 11*a* and portion 412*a* of coil conductor 12*a*, and distance Lc between portion 412*a* of coil conductor 12*a* and portion 413*a* of coil conductor 13*a* are substantially identical to one another. Each of portions 411*a*, 412*a*, and 413*a* of coil conductors 11*a*, 12*a*, and 13*a* constitutes corresponding one of the apexes of a regular triangle. Each of portions 311*a*, 312*a*, and 313*a* of coil conductors 11*a*, 12*a*, and 13*a* constitutes a corresponding one of the apexes of a regular triangle.

In other words, line PLa that connects coil conductor 11*a* and coil conductor 13*a*, line PLb that connects coil conductor 11*a* and coil conductor 12*a*, and line PLc that connects coil conductor 12*a* and coil conductor 13*a* form a regular triangle.

The distances between any two of coils 11, 12, and 13 are substantially identical to each other. Then, the balance of magnetic coupling can be further improved.

Distance Ld between portion 412*a* of coil conductor 12*a* at the N-th turn and portion 311*a* of coil conductor 11*a* at the (N−1)-th turn, and distance Le between portion 412*a* of coil conductor 12*a* at the N-th turn and portion 313*a* of coil conductor 13*a* at the (N−1)-th turn are substantially identical to distances La, Lb, and Lc.

A method for manufacturing coil conductors 11*a*, 12*a*, and 13*a* of common mode noise filter 1001 according to Embodiment 1 will be described below with reference to FIG. 3.

First, portion 13*a*1 of coil conductor 13*a* is formed on the upper surface of non-magnetic layer 14*a*.

Next, non-magnetic layer 14*b* is formed around portion 13*a*1 of coil conductor 13*a* on the upper surface of non-magnetic layer 14*a*.

Next, portion 13*a*2 of coil conductor 13*a* is formed on the upper surface of portion 13*a*1 of coil conductor 13*a*. Portion 12*a*1 of coil conductor 12*a* is formed on the upper surface of non-magnetic layer 14*b*. Then, non-magnetic layer 14*c* is formed around portions 12*a*1 and 13*a*2 of respective coil conductors 12*a* and 13*a* on the upper surface of non-magnetic layer 14*b*.

Next, portion 12*a*2 of coil conductor 12*a* is formed on the upper surface of portion 12*a*1 of coil conductor 12*a*. Then, non-magnetic layer 14*d* is formed around portion 12*a*2 of coil conductor 12*a* on the upper surface of non-magnetic layer 14*c*.

Next, remaining portion 12*a*3 of coil conductor 12*a* is formed on the upper surface of portion 12*a*2 of coil conductor 12*a*, and portion 11*a*1 of coil conductor 11*a* is formed on the upper surface of non-magnetic layer 14*d*. Then, non-magnetic layer 14*e* is formed around portions 11*a*1 and 12*a*3 of respective coil conductors 11*a* and 12*a* on the upper surface of non-magnetic layer 14*d*.

Next, remaining portion 11*a*2 of coil conductor 11*a* is formed on the upper surface of portion 11*a*1 of coil conductor 11*a*. Then, non-magnetic layer 14*f* is formed around portion 11*a*2 of coil conductor 11*a* on the upper surface of non-magnetic layer 14*e*.

Coil conductors 11*b*, 12*b*, and 13*b* are formed similarly to coil conductors 11*a*, 12*a*, and 13*a*.

Coil conductors 11*a*, 11*b*, 12*a*, 12*b*, 13*a*, and 13*b* may be formed by any one of sputtering (thin film sputtering), plating (transfer plating), and printing, or a combination thereof.

Figure 10:
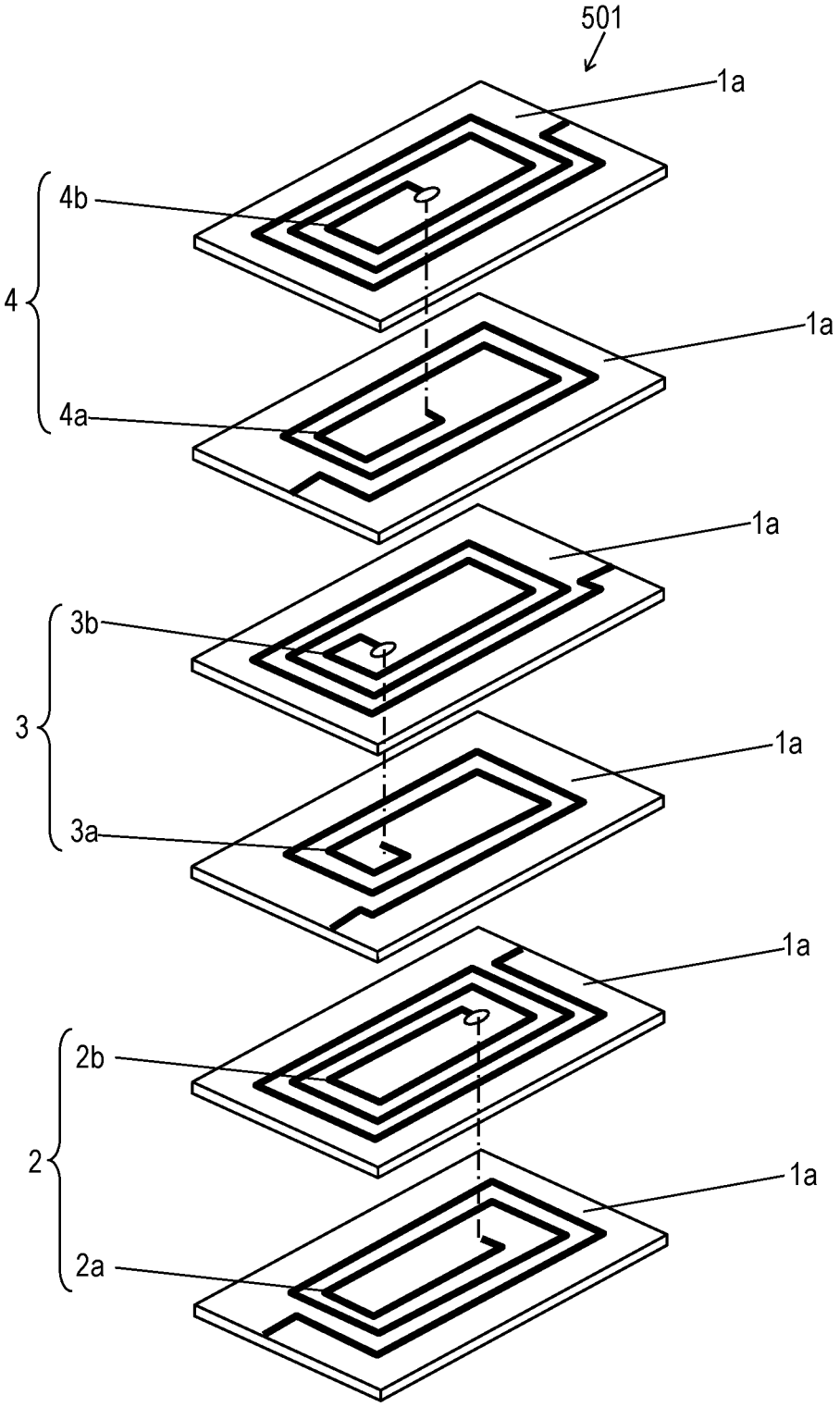
FIG. 10 Prior Art
FIG. 10 is an exploded perspective view of a conventional common mode noise filter.

In conventional common mode noise filter 501 illustrated in FIG. 10, coil 3 is disposed between coils 2 and 4, and accordingly, the distance between coils 2 and 4 is longer. Such distance causes coil 2 to be hardly magnetically coupled to coil 4.

Figure 4:
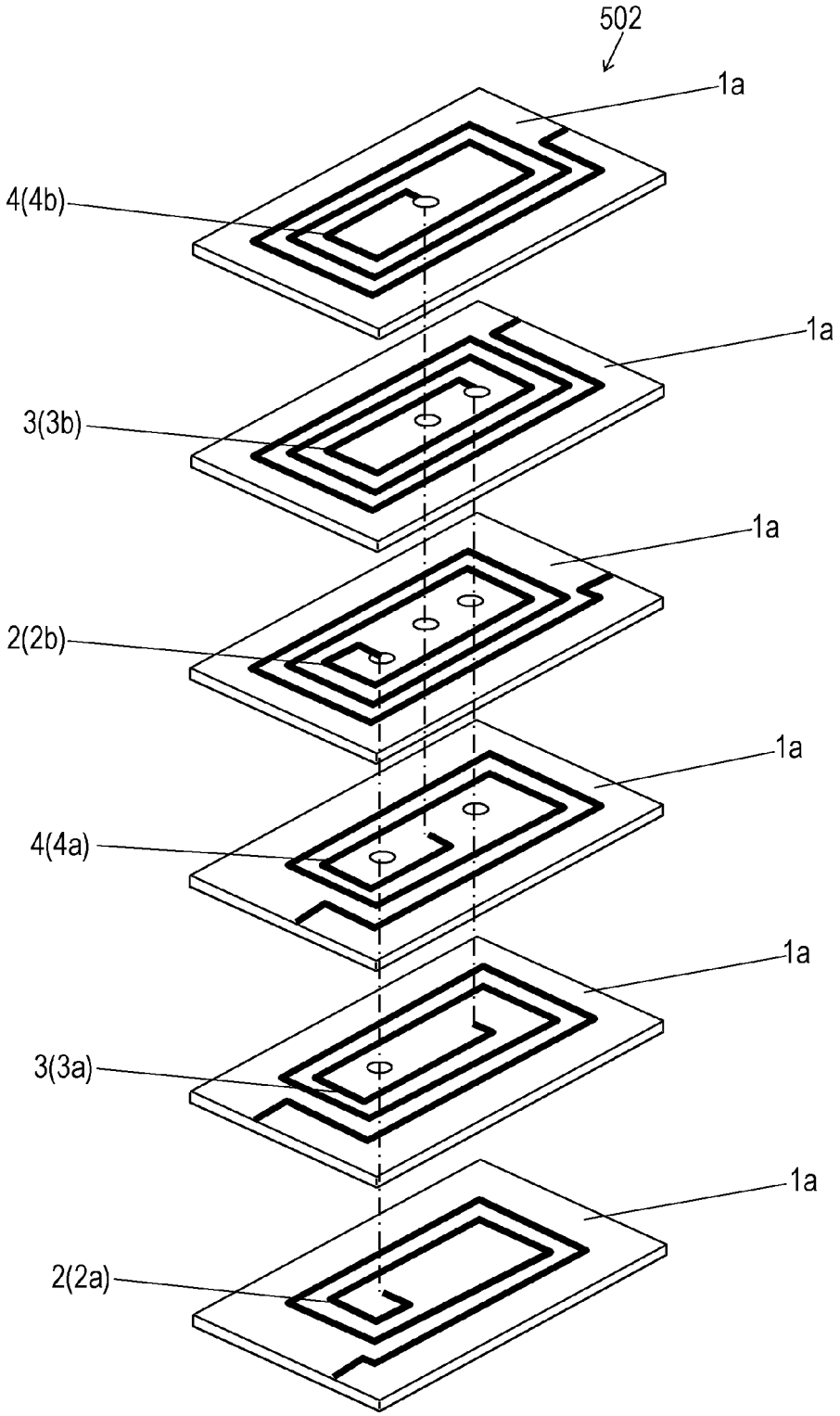
FIG. 4 is an exploded perspective view of the common mode noise filter of a comparative example.

In the case that common mode noise filter 501 is applied to a three-wire differential signal line, when differential data signals are transmitted with the signal line, magnetic fluxes generated in coils 2 and 4 that are not magnetically coupled to each other produces a large residual inductance without canceling each other out. This configuration increases a loss in the differential data signals and significant degradation in differential signal quality FIG. 4 is an exploded perspective view of a comparative example of common mode noise filter 502. In FIG. 4, components identical to those of common mode noise filter 501 illustrated in FIG. 10 are dented by the same reference numerals. In common mode noise filter 502 illustrated in FIG. 4, coil conductor 2*a* constituting coil 2, coil conductor 3*a* constituting coil 3, coil conductor 4*a* constituting coil 4, coil conductor 2*b* constituting coil 2, coil conductor 3*b* constituting coil 3, and coil conductor 4*b* constituting coil 4 are stacked in this order. Coils 2 and 3 are adjacent to each other at two locations, and coils 3 and 4 are adjacent to each other at two locations. This configuration enhances the magnetic coupling.

However, in the comparative example of common mode noise filter 502, coils 2 and 4 sandwich coil 3, and are accordingly more distant from each other. Thus, magnetic coupling between coils 2 and 4 is weaker than magnetic coupling between coils 2 and 3 and magnetic coupling between coils 3 and 4. Therefore, coils 2, 3, and 4 are magnetically coupled to each other with a poor balance. When differential signals are input to common mode noise filter 502 illustrated in FIG. 4, degradation of the differential signal is small in coil 3 since coil 3 is magnetically coupled to coils 2 and 4 adjacent to coil 3. However, in common mode noise filter 502, the distance between coil conductors 2*b* and 4*b* and the distance between coil conductors 2*a* and 4*a* are large, and accordingly, magnetic coupling between coil conductors 2*b* and 4*b* is weak and magnetic coupling between coil conductors 2*a* and 4*a* is weak. Therefore, the differential signals passing through coils 2 and 4 are degraded.

As described above, common mode noise filter 1001 according to Embodiment 1 prevents degradation of differential signals input to coils 11 to 13.

Figure 5A:
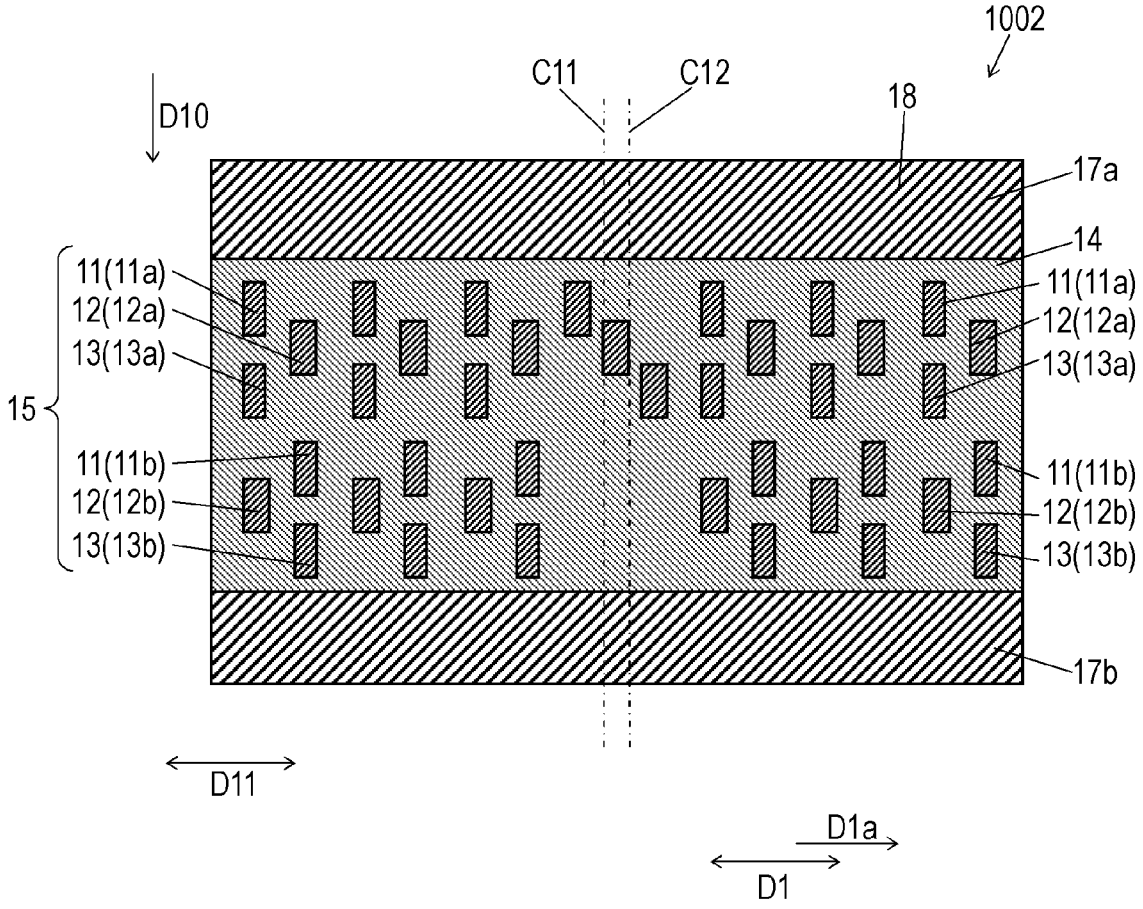
FIG. 5A is a cross-sectional view of another common mode noise filter according to Embodiment 1.
Figure 5B:
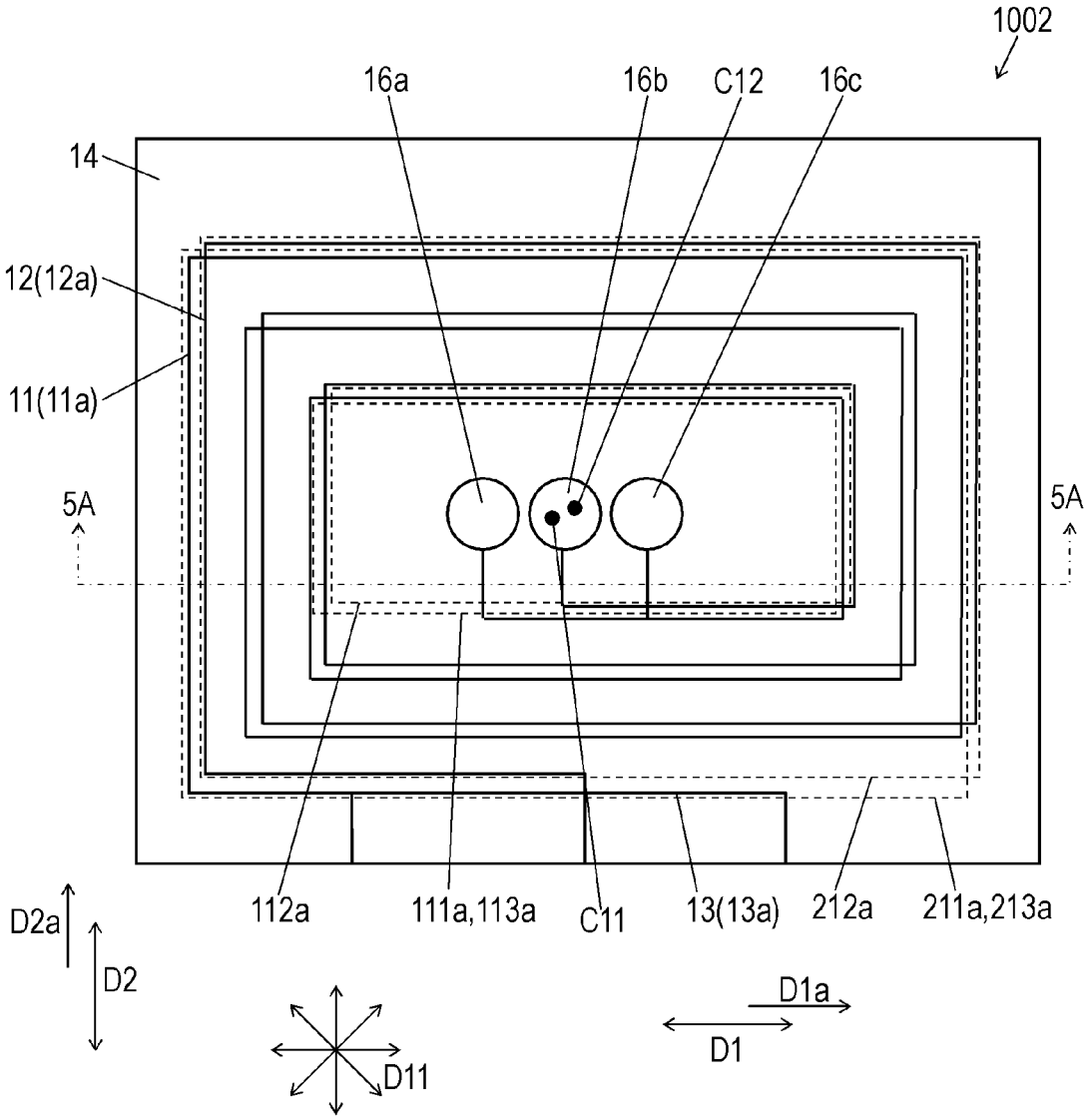
FIG. 5B is a top view of the common mode noise filter illustrated in FIG. 5A.

FIG. 5A is a cross-sectional view of another common mode noise filter 1002 according to Embodiment 1. FIG. 5B is a top view of common mode noise filter 1002. FIG. 5A illustrates a cross section of common mode noise filter 1002 along line 5A-5A shown in FIG. 5B. In FIG. 5A and FIG. 5B, components identical to those of common mode noise filter 1001 illustrated in FIG. 1 to FIG. 3 are denoted by the same reference numerals. In common mode noise filter 1002, coil conductors 11*a*, 12*b*, and 13*a* have spiral shapes wound about coil axis C11, and coil conductors 11*b*, 12*a*, and 13*b* have spiral shapes wound about coil axis C12. Coil axis C12 deviates with respect to coil axis C11 in a diagonal direction of the rectangular shape of the coil conductors, that is, in both of longitudinal direction D1 and lateral direction D2 of the rectangular shape. Coil conductor 11*a* overlaps coil conductor 13*a* viewing from above, and coil conductor 11*b* overlaps coil conductor 13*b* viewing from above. A portion of coil conductor 12*a* extending slenderly in longitudinal direction D1 deviates in direction D2*a* parallel to lateral direction D2 with respect to a portion of coil conductor 11*a* (13*a*) extending slenderly in longitudinal direction D1. A portion of coil conductor 12*a* extending slenderly in lateral direction D2 deviates in direction D1*a* parallel to longitudinal direction D1 with respect to the portion of coil conductor 11*a* (13*a*) extending slenderly in lateral direction D2. Common mode noise filter 1002 provides the same effect as common mode noise filter 1001.

Figure 6A:
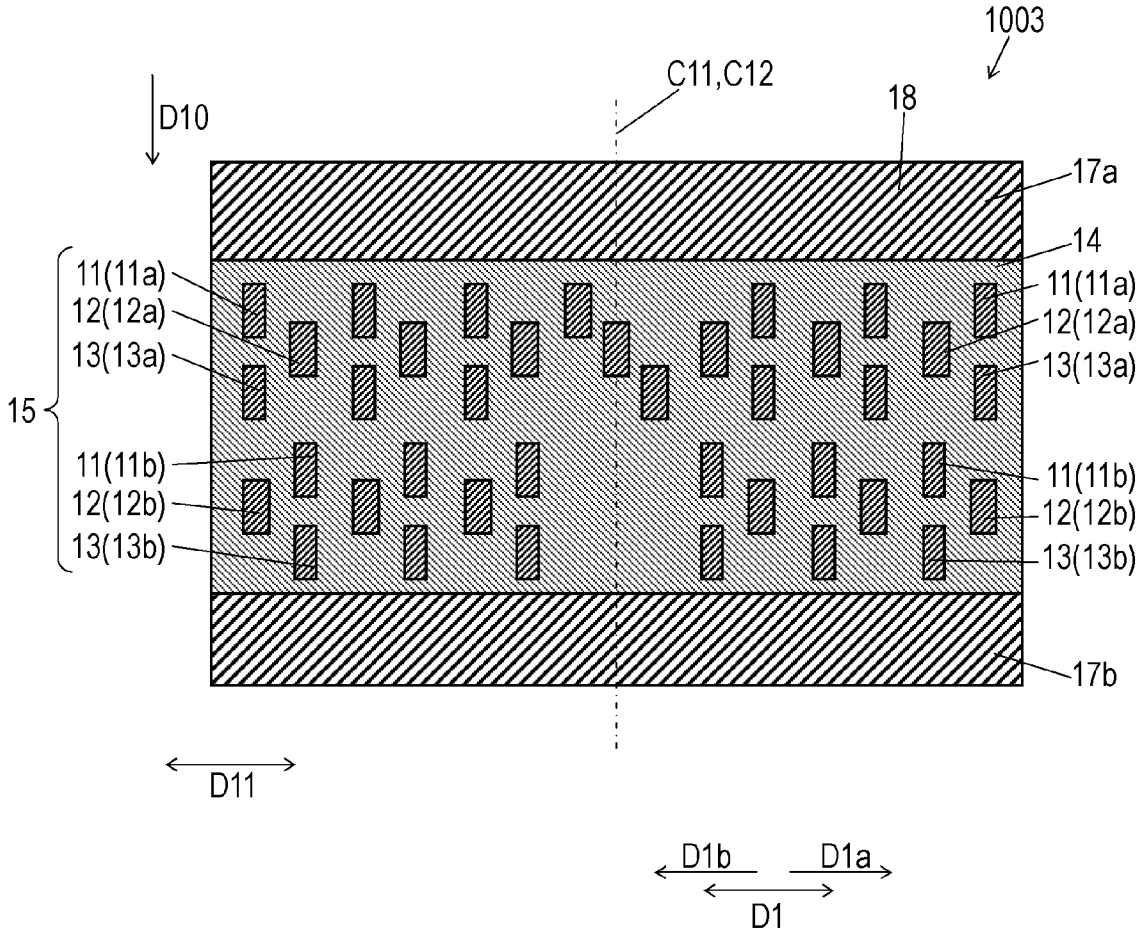
FIG. 6A is a cross-sectional view of still another common mode noise filter according to Embodiment 1.
Figure 6B:
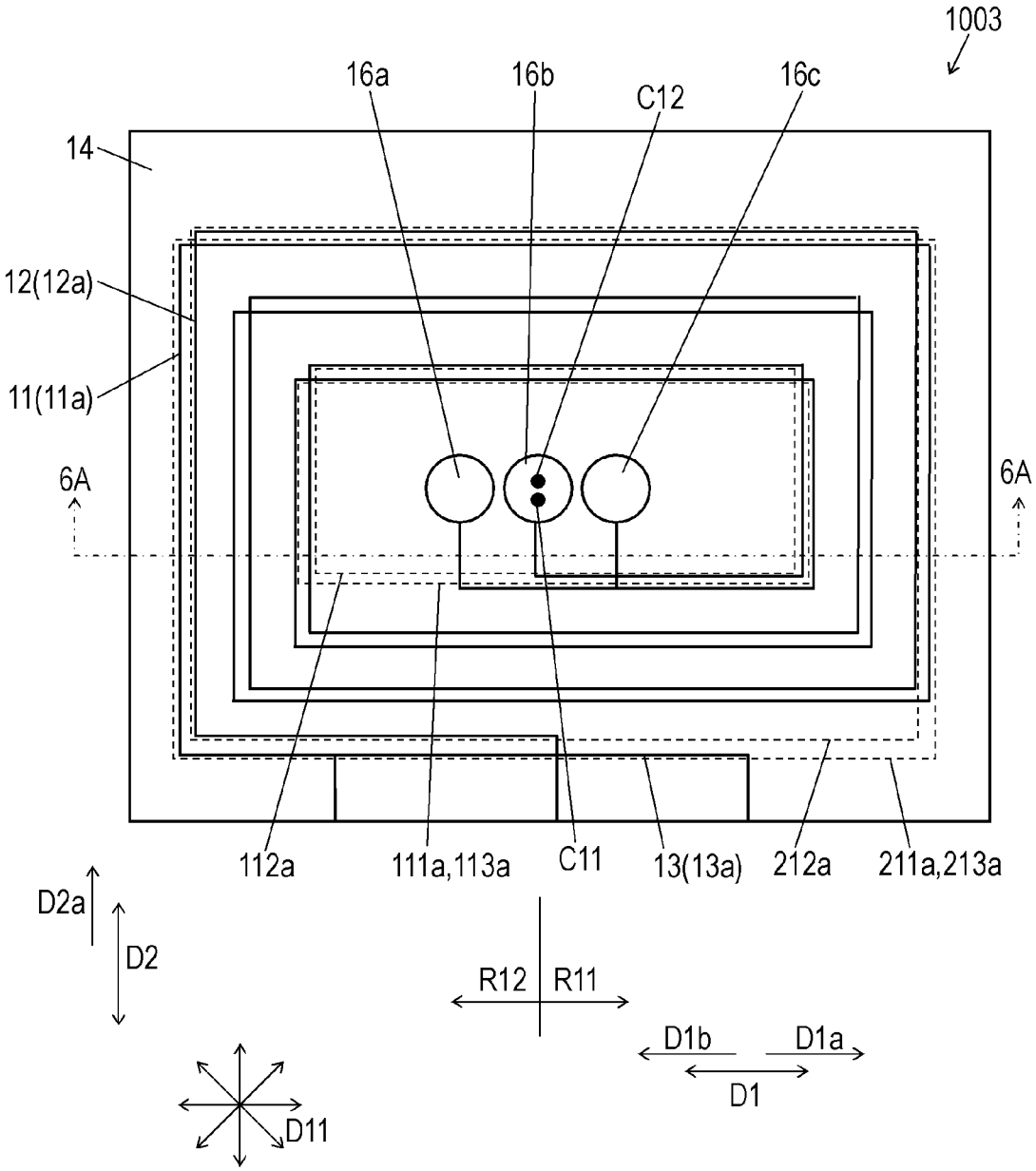
FIG. 6B is a top view of the common mode noise filter illustrated in FIG. 6A.

FIG. 6A is a cross-sectional view of still another common mode noise filter 1003 according to Embodiment 1. FIG. 6B is a top view of common mode noise filter 1003. FIG. 6A illustrates a cross section of common mode noise filter 1003 along line 6A-6A shown in FIG. 6B. In FIG. 6A and FIG. 6B, components identical to those of components of common mode noise filter 1002 illustrated in FIG. 5A and FIG. 5B are denoted by the same reference numerals. In common mode noise filter 1003, coil conductors 11*a*, 12*b*, and 13*a* have spiral shapes wound about coil axis C11, and coil conductors 11*b*, 12*a*, and 13*b* have spiral shapes wound about coil axis C12. Coil axis C12 deviates in direction D2*a* parallel to lateral direction D2, but does not deviate in longitudinal direction D1 with respect to coil axis C11. Specifically, coil conductors 11*a* and 13*a* overlap each other viewing from above, and coil conductors 11*b* and 13*b* overlap each other viewing from above. A portion of coil conductor 12*a* extending slenderly in longitudinal direction D1 deviates in direction D2*a* parallel to lateral direction D2 with respect to a portion of coil conductor 11*a* (13*a*) extending slenderly in longitudinal direction D1. A portion of coil conductor 12*a* extending slenderly in lateral direction D2 deviates in a direction D1*a* parallel to longitudinal direction D1 with respect to a portion of coil conductor 11*a* (13*a*) extending slenderly in lateral direction D2. Specifically, the portion of coil conductor 12*a* extending slenderly in lateral direction D2 includes a portion located in region R11 located in longitudinal direction D1 with respect to coil axes C11 and C12, and a portion located in region R12 opposite to region R11 in longitudinal direction D1 with respect to coil axes C11 and C12. The portion of coil conductor 12*a* extending slenderly in lateral direction D2 and being located in region R11 deviates in direction D1*b* parallel to longitudinal direction D1 with respect to the portion of coil conductor 11*a* (13*a*) extending slenderly in lateral direction D2 and being located in region R11. The portion of coil conductor 12*a* extending slenderly in lateral direction D2 and located in region R12 deviates in direction D1*a* parallel to longitudinal direction D1 and opposite to direction D1*b* with respect to the portion of coil conductor 11*a* (13*a*) extending slendlerly in lateral direction D2 and being located in region R12. Common mode noise filter 1003 provides the same effect as common mode noise filters 1001 and 1002.

Coil axis C12 of coil conductors 11*b*, 12*a*, and 13*b* deviates in longitudinal direction D1 with respect to coil axis C11 of coil conductors 11*a*, 12*b*, and 13*a*, but may not deviate in lateral direction D2 with respect to coil axis C11, providing same effect.

Figure 7:
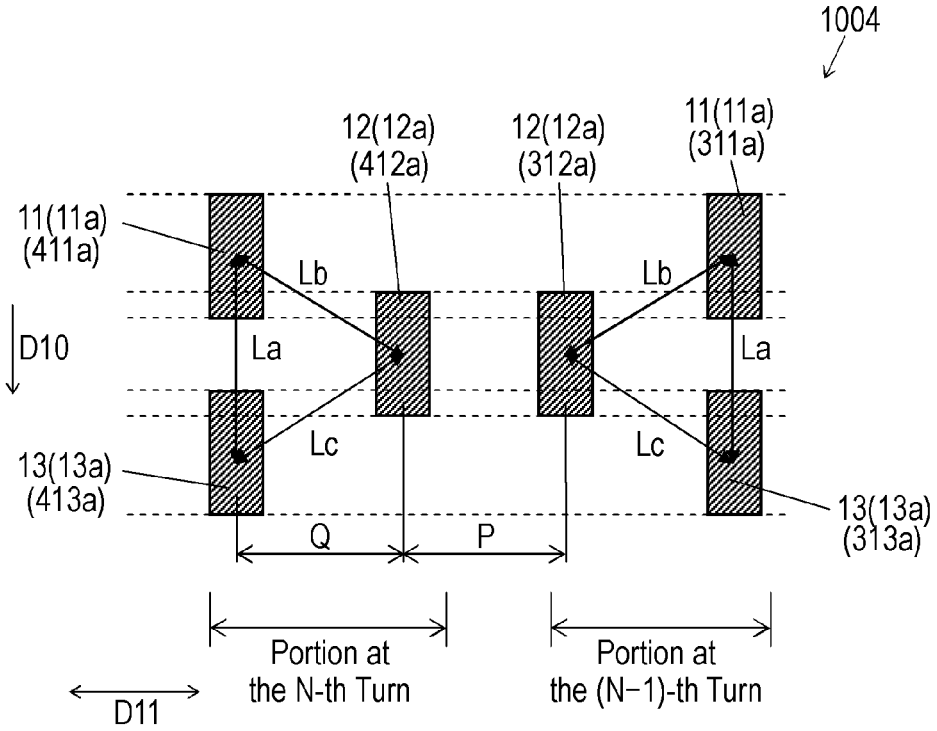
FIG. 7 is an enlarged cross-sectional view of a further common mode noise filter according to Embodiment 1.

FIG. 7 is an enlarged cross-sectional view of further common mode noise filter 1004 according to Embodiment 1.

In FIG. 7, components identical to those of common mode noise filter 1001 illustrated in FIG. 1 to FIG. 3 are denoted by the same reference numerals. In common mode noise filter 1004 illustrated in FIG. 7, viewing from above, portion 412*a* of coil conductor 12*a* at the N-th turn and portion 312*a* of coil conductor 12*a* at the (N−1)-th turn are located between portion 411*a* of coil conductor 11*a* at the N-th turn and portion 311*a* of coil conductor 11*a* at the (N−1)-th turn and located between portion 413*a* of coil conductor 13*a* at the N-th turn and portion 313*a* of coil conductor 13*a* at the (N−1)-th turn. Portions 312*a* and 412*a* of coil conductor 12*a* are adjacent to each other and have the same electric potential, and accordingly, distance P between portions 312*a* and 412*a* of coil conductor 12*a* can be reduced. This configuration can increase the number of turns of each of coils 11, 12, and 13. Viewing from above, distance Q between portion 412*a* of coil conductor 12*a* and each of portions 411*a* and 413*a* of coil conductors 11*a* and 13*a*, in other words, between portion 312*a* of coil conductor 12*a* and each of portions 311*a* and 313*a* of respective coil conductors 11*a* and 13*a* is larger than distance P.

Figure 8:
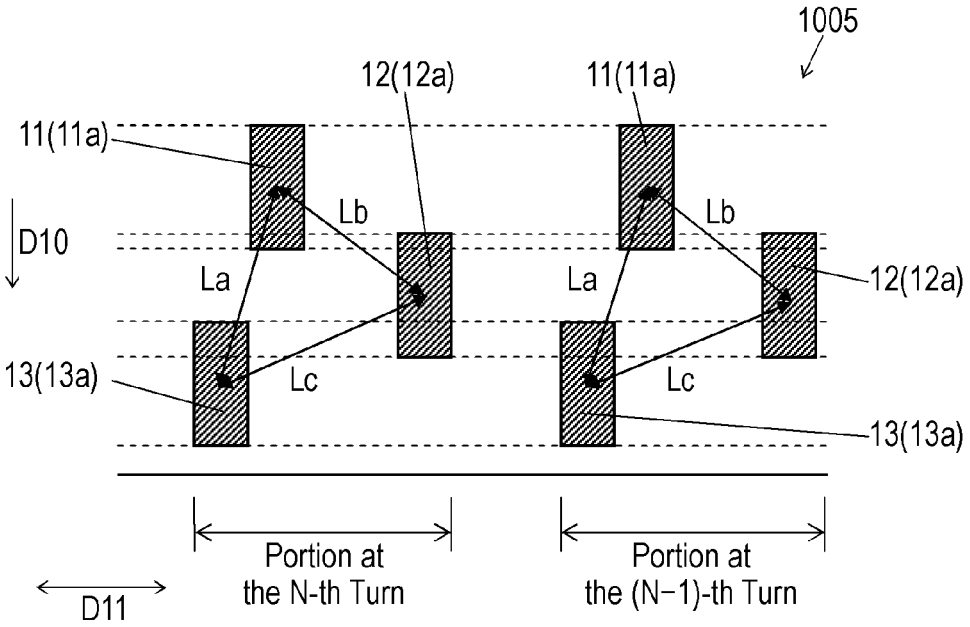
FIG. 8 is an enlarged cross-sectional view of a further common mode noise filter according to Embodiment 1.

FIG. 8 is an enlarged cross-sectional view of further common mode noise filter 1005 according to Embodiment 1. In FIG. 8, components identical to those of common mode noise filter 1001 illustrated in FIG. 1 to FIG. 3 are denoted by the same reference numerals. In common mode noise filter 1005 illustrated in FIG. 8, coil conductors 11*a*, 12*a*, and 13*a* do not overlap one another viewing from above. Coil conductors 11*b*, 12*b*, and 13*b* do not overlap one another viewing from above.

In common mode noise filter 1001 illustrated in FIG. 1 to FIG. 3, the capacitance between coil conductors 11*a* and 13*a* facing each other and overlapping viewing from above is larger than the capacitance between coil conductors 11*a* and 12*a* facing each other in a smaller area and the capacitance between coil conductors 12*a* and 13*a* facing each other in a smaller area. In common mode noise filter 1005 illustrated in FIG. 8, coil conductor 11*a* does not overlap coil conductor 13*a* viewing from above, hence reducing the capacitance between coil conductors 11*a* and 13*a*. This configuration allows, in common mode noise filter 1005, the capacitances between coil conductors 11*a*, 12*a*, and 13*a* to be well-balanced, thereby preventing degradation of differential signals input to common mode noise filter 1005.

Exemplary Embodiment 2

Figure 9:
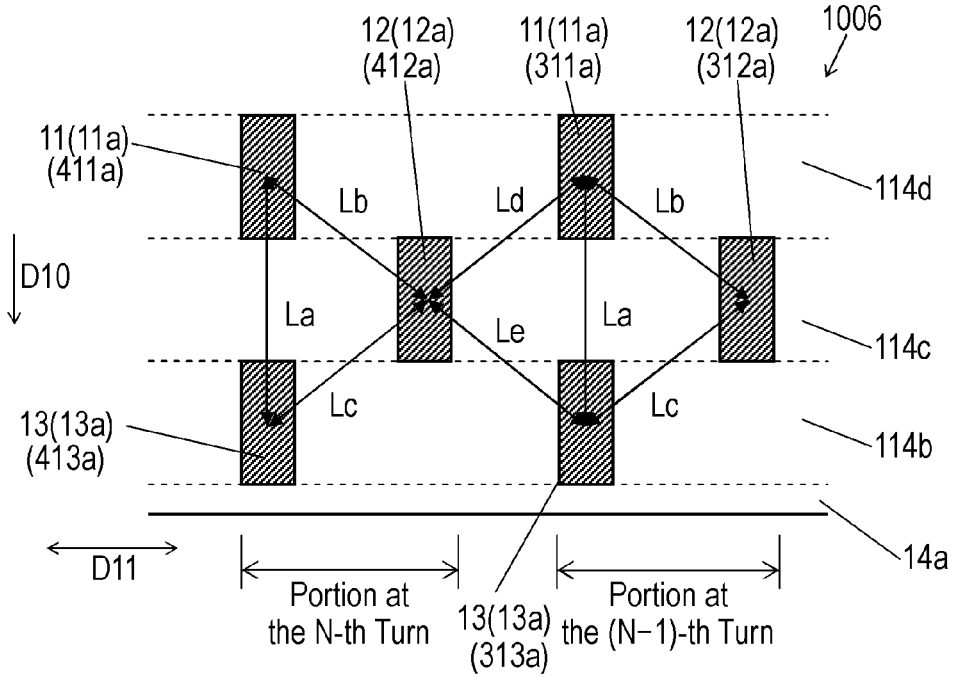
FIG. 9 is an enlarged cross-sectional view of a common mode noise filter according to Exemplary Embodiment 2.

FIG. 9 is an enlarged cross-sectional view of common mode noise filter 1006 according to Exemplary Embodiment 2. In FIG. 9, components identical to those of common mode noise filter 1001 illustrated in FIG. 1 to FIG. 3 are denoted by the same reference numerals.

In common mode noise filter 1006 according to Embodiment 2 illustrated in FIG. 9, unlike in common mode noise filter 1001 according to Embodiment 1, coil conductor 11*a* constituting coil 11, coil conductor 12*a* constituting coil 12, and coil conductor 13*a* constituting coil 13 do not overlap each other viewing from direction D11 perpendicular to downward direction D10. Furthermore, the upper surface of coil conductor 12*a* is flush with the lower surface of coil conductor 11*a*. The lower surface of coil conductor 12*a* is flush with the upper surface of coil conductor 13*a*.

Similarly to common mode noise filter 1001 according to Embodiment 1, in common mode noise filter 1006, distances La, Lb, and Lc are substantially identical to one another. Each of portions 411*a*, 412*a*, and 413*a* of coil conductors 11*a*, 12*a*, and 13*a* constitutes a corresponding one of the apexes of a regular triangle. Each of portions 311*a*, 312*a*, and 313*a* of coil conductors 11*a*, 12*a*, and 13*a* constitutes a corresponding one of the apexes of a regular triangle.

In common mode noise filter 1006, each coil conductor overlaps only one non-magnetic layer in direction D11, and hence, it is not necessary to form one coil conductor with plural processes. Therefore, common mode noise filter 1006 can be more easily manufactured than common mode noise filter 1001 according to Embodiment 1.

Viewing from direction D11, any other non-magnetic layer is not provided between the upper surface of coil conductor 12*a* and the lower surface of coil conductor 11*a*, and any other non-magnetic layer is not provided between the lower surface of coil conductor 12*a* and the upper surface of coil conductor 13*a*. This configuration allows coil conductors 11*a* to 13 to be strongly magnetically coupled to each other.

The size and arrangement of the coil conductors are adjusted so that any two of three coil conductor portions at the same number of turn are magnetically coupled at approximately the same strength level.

In common mode noise filter 1006, coil conductors 11*a* to 13*a* may be disposed similarly to common mode noise filter 1004 according to Embodiment 1 illustrated in FIG. 7. Alternatively, in common mode noise filter 1006, coil conductors 11*a* to 13*a* may be disposed similarly to common mode noise filter 1005 according to Embodiment 1 illustrated in FIG. 8.

The above-described enlarged cross-sectional views shown in FIG. 3 and FIG. 7 to FIG. 9 illustrate coil conductors 11*a*, 12*a*, and 13*a* constituting respective coils 11, 12, and 13, but coil conductors 11*b*, 12*b*, and 13*b* constituting respective coils 11, 12, and 13 may be disposed in the same manner as above.

In Embodiments, terms, such as "upper surface", "lower surface", "downward", and "viewing from above", indicating directions indicate relative directions depending only on the relative positional relationship between components, such as coil conductors, of a common mode noise filter, and do not indicate absolute directions, such as a vertical direction.

REFERENCE MARKS IN THE DRAWINGS

11 coil
11*a* coil conductor (first coil conductor)
11*b* coil conductor
12 coil
12*a* coil conductor (second coil conductor)
12*b* coil conductor
13 coil
13*a* coil conductor (third coil conductor)
13*b* coil conductor
14 non-magnetic body
15 laminated body

The invention claimed is:

1. A common mode noise filter comprising:

a non-magnetic body;

a first coil conductor provided inside the non-magnetic body and having a spiral shape with one or more turns;

a second coil conductor provided inside the non-magnetic body and in a downward direction from the first coil conductor, the second coil conductor having a spiral shape with one or more turns that extends in parallel with the spiral shape of the first coil conductor to be magnetically coupled to the first coil conductor; and a third coil conductor provided inside the non-magnetic body and in the downward direction from the second coil conductor, the third coil conductor having a spiral shape with one or more turns that extends in parallel with the spiral shape of the first coil conductor and the spiral shape of the second coil conductor to be magnetically coupled to the first coil conductor and the second coil conductor, wherein the first coil conductor, the second coil conductor, and the third coil conductor are insulated from one another, wherein the first coil conductor and the third coil conductor deviate in a direction perpendicular to the downward direction with respect to the second coil conductor, wherein the first coil conductor, the second coil conductor, and the third coil conductor do not overlap each other viewing from the direction perpendicular to the downward direction, wherein an upper surface of the second coil conductor is flush with a lower surface of the first coil conductor, wherein a lower surface of the second coil conductor is flush with an upper surface of the third coil conductor, wherein the spiral shape of the first coil conductor has M turns from a first inner circumference of the first coil conductor to a first outer circumference of the first coil conductor, where M is a number equal to or greater than one, wherein the spiral shape of the second coil conductor has M turns from a second inner circumference of the second coil conductor to a second outer circumference of the second coil conductor, wherein the spiral shape of the third coil conductor has M turns from a third inner circumference of the third coil conductor to a third outer circumference of the third coil conductor, and wherein, for every number N satisfying $1 \leq N \leq M$, when viewed from above, an entire portion of the second coil conductor at an N-th turn from the second inner circumference of the second coil conductor is surrounded by an entire portion of the first coil conductor at an N-th turn from the first inner circumference of the first coil conductor and an entire portion of the third coil conductor at the Nth turn from the third inner circumference of the third coil conductor.

2. The common mode noise filter according to claim 1, wherein, in a cross-section parallel with the downward direction, each of a portion of the first coil conductor at an N-th turn from the first inner circumference of the first coil conductor, a portion of the second coil conductor at an N-th turn from the second inner circumference of the second coil conductor, and a portion of the third coil conductor at the Nth turn from the third inner circumference of the third coil conductor constitutes respective one of apexes of a regular triangle.

3. The common mode noise filter according to claim 1, wherein the first coil conductor, the second coil conductor, and the third coil conductor do not overlap each other viewing from above.

4. The common mode noise filter according to claim 1, wherein the spiral shape of the first coil conductor, the spiral shape of the second coil conductor, and the spiral shape of the third coil conductor are identical to each other.

5. The common mode noise filter according to claim 1, further comprising:

a fourth coil conductor provided inside the non-magnetic body and having a spiral shape with one or more turns;

a fifth coil conductor provided inside the non-magnetic body and in the downward direction from the fourth coil conductor, the fifth coil conductor having a spiral shape with one or more turns that extends in parallel with the spiral shape of the fourth coil conductor to be magnetically coupled to the fourth coil conductor; and a sixth coil conductor provided inside the non-magnetic body and in the downward direction from the fifth coil conductor, the sixth coil conductor having a spiral shape with one or more turns that extends in parallel with the spiral shape of the forth coil conductor and the spiral shape of the fifth coil conductor to be magnetically coupled to the fourth coil conductor and the fifth coil conductor, wherein the fourth coil conductor and the sixth coil conductor deviate in a direction perpendicular to the downward direction with respect to the fifth coil conductor, wherein the fourth coil conductor, the fifth coil conductor, and the sixth coil conductor do not overlap each other viewing from the direction perpendicular to the downward direction, wherein an upper surface of the fifth coil conductor is flush with a lower surface of the fourth coil conductor, wherein a lower surface of the fifth coil conductor is flush with an upper surface of the sixth coil conductor, wherein the spiral shape of the fourth coil conductor has M turns from a fourth inner circumference of the fourth coil conductor to a fourth outer circumference of the fourth coil conductor, wherein the spiral shape of the fifth coil conductor has M turns from a fifth inner circumference of the fifth coil conductor to a fifth outer circumference of the fifth coil conductor, and wherein the spiral shape of the sixth coil conductor has M turns from a sixth inner circumference of the sixth coil conductor to a sixth outer circumference of the sixth coil conductor.

6. The common mode noise filter according to claim 5, wherein, when viewed from above, an entire portion of the fourth coil conductor at an N-th turn from the fourth inner circumference of the fourth coil conductor and an entire portion of the sixth coil conductor at an N-th turn from the sixth inner circumference of the sixth coil conductor are surrounded by an entire portion of the fifth coil conductor at the Nth turn from the fifth inner circumference of the fifth coil conductor.

7. The common mode noise filter according to claim 6, wherein the spiral shape of the fourth coil conductor, the spiral shape of the fifth coil conductor, and the spiral shape of the sixth coil conductor are wound about a coil axis, and wherein the entire portion of the fourth coil conductor at an N-th turn from the fourth inner circumference of the fourth coil conductor and the entire portion of the sixth coil conductor at an N-th turn from the sixth inner circumference of the sixth coil conductor are farther from the coil axis than the entire portion of the fifth coil conductor at the Nth turn from the fifth inner circumference of the fifth coil conductor.

8. The common mode noise filter according to claim 6, wherein the fourth coil conductor is connected in series to the first coil conductor, wherein the fifth coil conductor is connected in series to the second coil conductor, and wherein the sixth coil conductor is connected in series to the third coil conductor.

9. The common mode noise filter according to claim 5, wherein the fourth coil conductor is connected in series to the first coil conductor, wherein the fifth coil conductor is connected in series to the second coil conductor, and wherein the sixth coil conductor is connected in series to the third coil conductor.

10. The common mode noise filter according to claim 5, wherein the spiral shape of the first coil conductor, the spiral shape of the second coil conductor, and the spiral shape of the third coil conductor are wound about a coil axis, and wherein the entire portion of the second coil conductor at an N-th turn from the second inner circumference of the second coil conductor is farther from the coil axis than the entire portion of the first coil conductor at an N-th turn from the first inner circumference of the first coil conductor and the entire portion of the third coil conductor at the Nth turn from the third inner circumference of the third coil conductor.

* * * * *